US011480080B2

(12) United States Patent
Kondo et al.

(10) Patent No.: US 11,480,080 B2
(45) Date of Patent: Oct. 25, 2022

(54) MUFFLER

(71) Applicant: FUTABA INDUSTRIAL CO., LTD., Okazaki (JP)

(72) Inventors: Seiji Kondo, Okazaki (JP); Shinnosuke Toichi, Okazaki (JP); Katsuhiko Kainuma, Okazaki (JP)

(73) Assignee: FUTABA INDUSTRIAL CO., LTD., Okazaki (JP)

( * ) Notice: Subject to any disclaimer, the term of this patent is extended or adjusted under 35 U.S.C. 154(b) by 219 days.

(21) Appl. No.: 16/750,800

(22) Filed: Jan. 23, 2020

(65) Prior Publication Data

US 2020/0240300 A1 Jul. 30, 2020

(30) Foreign Application Priority Data

Jan. 28, 2019 (JP) ..... JP2019-012428

(51) Int. Cl.
*F01N 1/02* (2006.01)

(52) U.S. Cl.
CPC ..... *F01N 1/02* (2013.01); *F01N 2470/02* (2013.01)

(58) Field of Classification Search
CPC .. F01N 1/166; F01N 2470/18; F01N 2490/15; F01N 2470/02; F01N 1/084; F01N 2470/24; F01N 1/02; F01N 2240/20
See application file for complete search history.

(56) References Cited

U.S. PATENT DOCUMENTS 2,151,470 A * 3/1939 Hollerith ..... F01N 1/02 181/266
3,070,187 A * 12/1962 Deremer ..... F01N 1/023 181/238

(Continued)

FOREIGN PATENT DOCUMENTS

JP S54143941 U 10/1979
JP S55001931 U 1/1980

(Continued)

OTHER PUBLICATIONS

Notice of Reason(s) for Rejection for Japanese Patent Application No. 2019-012428 dated Feb. 2, 2021, 10 pages including English machine translation.

(Continued)

*Primary Examiner* — Anthony Ayala Delgado
(74) *Attorney, Agent, or Firm* — Withrow & Terranova, P.L.L.C.; Vincent K. Gustafson

(57) ABSTRACT

Provided is a muffler that can reduce sound pressure of a standing wave in an outlet pipe and, at the same time, can inhibit generation of flow noise. In one aspect of the present disclosure, the muffler includes a housing, an outlet pipe, a cover that covers the outlet pipe. The outlet pipe includes an outlet end and at least one communication hole. The outlet end opens into the housing. The at least one communication hole is formed in an outer circumferential surface of the outlet pipe. The cover includes a wall portion and an opening. The wall portion is disposed to overlap with the at least one communication hole in a radial direction of the outlet pipe. The opening communicates the at least one communication hole and an internal space of the housing with each other.

9 Claims, 5 Drawing Sheets

(56) References Cited

U.S. PATENT DOCUMENTS

| | | | | |
|---|---|---|---|---|
| 3,209,858 | A * | 10/1965 | Jettinghoff | F01N 1/026 181/266 |
| 3,389,764 | A * | 6/1968 | Kelso | F01N 1/084 181/266 |
| 3,741,336 | A * | 6/1973 | Malosh | F01N 1/02 181/266 |
| 4,719,988 | A * | 1/1988 | Kinouchi | F01N 1/003 181/265 |
| 5,723,827 | A * | 3/1998 | Sasaki | F01N 1/02 181/237 |
| 5,801,344 | A * | 9/1998 | Herold | F01N 1/02 181/265 |
| 6,467,570 | B1 * | 10/2002 | Herold | F01N 3/0226 181/231 |
| 6,968,922 | B2 * | 11/2005 | Kawamata | F01N 1/083 181/231 |
| 8,550,210 | B2 * | 10/2013 | Kondou | F01N 1/023 181/251 |
| 9,453,452 | B2 | 9/2016 | Kondo et al. | |
| 9,523,304 | B2 * | 12/2016 | Furuya | F01N 13/007 |
| 9,624,812 | B2 * | 4/2017 | Hayama | F01N 1/089 |
| 10,196,948 | B2 * | 2/2019 | Masui | F01N 1/083 |
| 2005/0103567 | A1 * | 5/2005 | Petracek | F01N 1/006 181/269 |
| 2006/0000668 | A1 | 1/2006 | Yamaguchi et al. | |
| 2012/0261210 | A1 * | 10/2012 | Kondou | F01N 1/023 181/228 |
| 2012/0273302 | A1 * | 11/2012 | Takagaki | F01N 1/06 181/228 |
| 2015/0192055 | A1 | 7/2015 | Kondo et al. | |
| 2015/0354421 | A1 * | 12/2015 | Hörr | F01N 1/163 181/241 |
| 2016/0333756 | A1 * | 11/2016 | Hörr | F01N 1/166 |

FOREIGN PATENT DOCUMENTS

| | | | |
|---|---|---|---|
| JP | S63136219 | U | 9/1988 |
| JP | H09273423 | A | 10/1997 |
| JP | 6100490 | B2 | 3/2017 |
| JP | 6373062 | B2 | 8/2018 |
| WO | 2011080793 | A1 | 7/2011 |
| WO | 2018029864 | A1 | 2/2018 |

OTHER PUBLICATIONS

Office Action for Chinese Patent Application No. 202010076716.5 dated Aug. 19, 2021, 8 pages including English machine translation.

Examination Report for Indian Patent Application No. 202034002244, dated Apr. 23, 2021, 5 pages.

* cited by examiner

MUFFLER

CROSS-REFERENCE TO RELATED APPLICATIONS

This application claims the benefit of Japanese Patent Application No. 2019-012428 filed on Jan. 28, 2019 with the Japan Patent Office, the entire disclosure of which is incorporated herein by reference.

BACKGROUND

The present disclosure relates to a muffler.

Known is a muffler that releases exhaust gas, which is introduced into a housing, to the outside of the housing through an outlet pipe in an exhaust system of an internal combustion engine (see, Japanese Unexamined Patent Application Publication No. H9-273423).

SUMMARY

The above-described muffler causes increase in resonance sound due to generation of a standing wave in the outlet pipe. To address this, a perforation is formed in an outer circumference surface of the outlet pipe, to thereby seek reduction of sound pressure of the standing wave.

However, if the outer circumferential surface of the outlet pipe is perforated, exhaust gas enters into the outlet pipe through this perforation. As a result, a main flow of the exhaust gas present in the outlet pipe and a tributary flow of the exhaust gas running through the perforation encounter against each other, thus generating flow noise.

In one aspect of the present disclosure, it is preferable to provide a muffler that can reduce sound pressure of a standing wave in an outlet pipe and, at the same time, can inhibit generation flow noise.

In one aspect of the present disclosure, a muffler comprises a housing, an inlet pipe that is configured to introduce exhaust gas into the housing, an outlet pipe that is configured to release the exhaust gas from an inside of the housing, and a cover that covers at least a part of an outer circumferential surface of the outlet pipe. The outlet pipe includes an outlet end and at least one communication hole. The outlet end opens into the housing. The at least one communication hole is formed in the outer circumferential surface of the outlet pipe. The cover includes a wall portion and an opening. The wall portion is disposed to overlap with the at least one communication hole in a radial direction of the outlet pipe. The opening communicates the at least one communication hole and an internal space of the housing with each other.

According to this configuration, the cover, which includes the wall portion and the opening, contributes to increase in flow path length of a tributary flow that runs into the outlet pipe from the at least one communication hole. As a result, it is possible to decrease a flow speed of the exhaust gas in the tributary flow relative to a flow speed of the exhaust gas in a main flow that runs into the outlet pipe from the outlet end. Accordingly, with a help of the at least one communication hole, sound pressure of a standing wave in the outlet pipe is reduced and, at the same time, generation of flow noise, which occurs when the tributary flow and the main flow are merged together in the outlet pipe, is inhibited.

In one aspect of the present disclosure, a total area of the at least one communication hole may be smaller than an opening area of the outlet end. This configuration increases a flow rate of the exhaust gas flowing into the outlet pipe from the outlet end relative to a flow rate of the exhaust gas flowing into the outlet pipe from the at least one communication hole. As a result, a flow speed in the tributary flow decreases, thus properly exhibiting effect to inhibit generation of flow noise.

In one aspect of the present disclosure, the inlet pipe may include an inlet end that opens into the housing. The opening of the cover may be disposed at a position that is displaced from a main flow path of the exhaust gas running from the inlet end to the outlet end. According to this configuration, the exhaust gas, which is released from the inlet end, is less likely to be directly supplied to the opening of the cover. Consequently, it is possible to inhibit generation of flow noise at the opening of the cover.

In one aspect of the present disclosure, the opening of the cover may include at least one auxiliary communication hole that is provided to the cover. This configuration facilitates adjustment of the flow rate of the exhaust gas at the opening of the cover.

In one aspect of the present disclosure, the at least one auxiliary communication hole may be disposed at a position that is displaced with respect to the at least one communication hole in at least one of a circumferential direction of the outlet pipe or a central axial direction of the outlet pipe. According to this configuration, it is possible to more surely inhibit generation of the flow noise at the opening of the cover.

In one aspect of the present disclosure, the cover may be a cylindrical body that is disposed outside the outlet pipe. This configuration facilitates formation of the outlet pipe to which the cover is mounted. As a result, it is possible to enhance productivity of the muffler.

In one aspect of the present disclosure, the at least one auxiliary communication hole may be disposed opposite to the at least one communication hole across a virtual plane that includes a central axis of the outlet pipe. This configuration increases a distance from the at least one auxiliary communication hole to the at least one communication hole of the outlet pipe, thus further reducing the flow speed of the exhaust gas in the tributary flow. Consequently, effect to inhibit generation of the flow noise is expedited.

In one aspect of the present disclosure, the cover may cover a part of an outer circumferential surface of the outlet pipe in a circumferential direction of the outlet pipe. This configuration can reduce the cover in size as minimum as required. As a result, it is possible to reduce a material cost of the muffler.

In one aspect of the present disclosure, the cover may include a guide portion that is configured to guide the exhaust gas to the opening. This configuration encourages the exhaust gas to be collected at the opening of the cover, thus inhibiting dispersion of the exhaust gas (in other words, generation of turbulence) in the housing. As a result, the effect to inhibit generation of the flow noise is expedited.

In one aspect of the present disclosure, the opening may be disposed to have a specified distance from the outer circumferential surface of the outlet pipe and the opening may include an opened end that is configured to introduce the exhaust gas between the wall portion and the outer circumferential surface of the outlet pipe. According to this configuration, it is possible to reduce man-hour of fixing work for fixing the cover to the outlet pipe using, for example, welding. As a result, the muffler has enhanced productivity.

BRIEF DESCRIPTION OF THE DRAWINGS

Embodiments of the present disclosure will be described hereinafter by way of example with reference to the accompanying drawings, in which.

DETAILED DESCRIPTION OF EXEMPLARY EMBODIMENTS

1. First Embodiment

[1-1. Configuration]

Figure 1A:
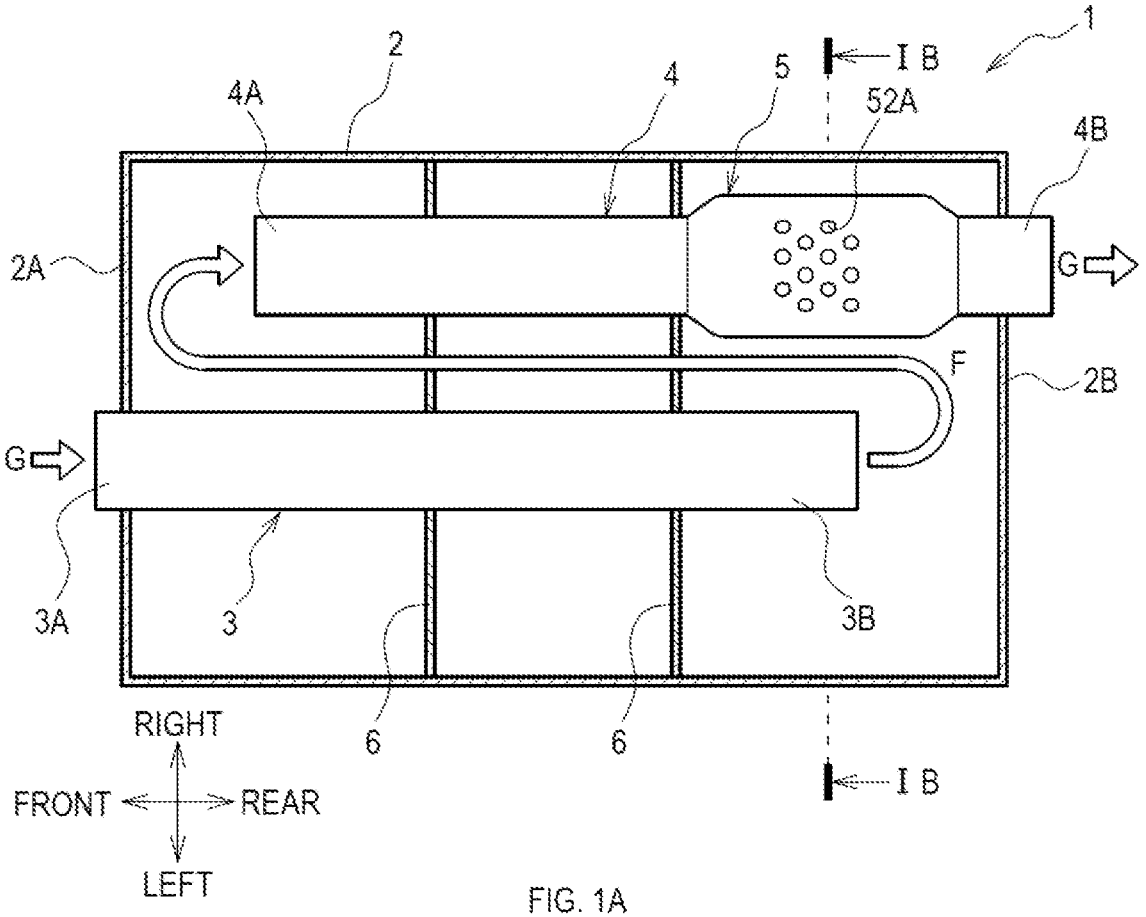
FIG. 1A is a schematic diagram showing an internal configuration of a muffler of an embodiment.

A muffler 1 shown in FIG. 1A is disposed in an exhaust gas flow path of an internal combustion engine. The muffler 1 comprises a housing 2, an inlet pipe 3, an outlet pipe 4, a cover 5, and separators 6.

The internal combustion engine, to which the muffler 1 is applied, is not particularly limited. However, the internal combustion engine can be used for generating power in or driving a transportation machine, such as automobiles, railroad vehicles, ships and boats, and construction machines, power generation facilities, and the like.

<Housing>

The housing 2 includes an internal space, in which a part of the inlet pipe 3 and a part of the outlet pipe 4 are disposed.

In the present embodiment, the housing 2 is a cylindrical body with a bottom. A first bottom wall 2A of the housing 2 receives the inlet pipe 3 inserted therethrough. A second bottom wall 2B of the housing 2 receives the outlet pipe 4 inserted therethrough. The internal space of the housing 2 is sealed except respective portions where the inlet pipe 3 and the outlet pipe 4 are inserted.

Figure 1B:
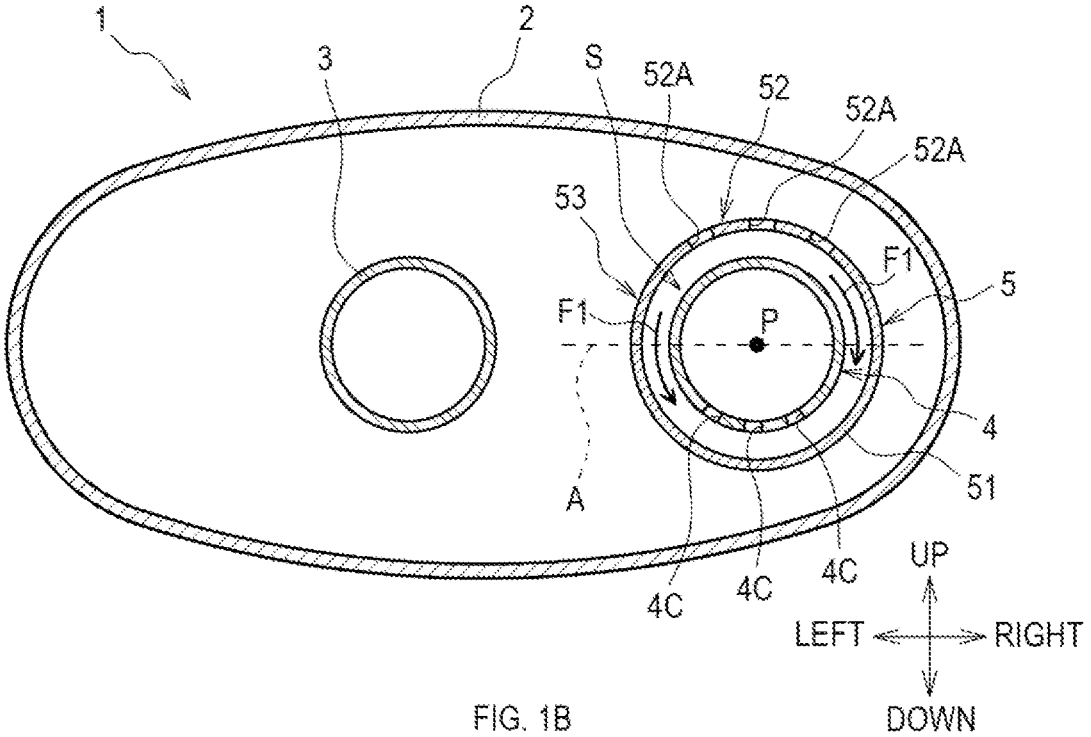
FIG. 1B is a schematic sectional view along a line IB-IB of FIG. 1A.

In the present embodiment, the housing 2 has a cross section that is shaped in an ellipse as shown in FIG. 1B. The housing 2 is placed in a vehicle, such as an automobile or the like, in an orientation where the major axis of the ellipse is parallel to a horizontal direction. However, a placement orientation of the housing 2 is not limited to the aforementioned orientation. In addition, a shape of the cross section of the housing 2 is not limited to a shape of ellipse.

<Inlet Pipe>

The inlet pipe 3 is configured to introduce exhaust gas G into the housing 2. The inlet pipe 3 includes a first inlet end 3A and a second inlet end 3B. The first inlet end 3A opens outward of the housing 2. The second inlet end 3B opens into the housing 2.

The first inlet end 3A is coupled to an exhaust pipe that is located in the upstream of the muffler 1 in the exhaust gas flow path of the internal combustion engine. The exhaust gas G is supplied into the housing 2 through the second inlet end 3B. In the present embodiment, the inlet pipe 3 is a straight pipe that extends in parallel to the central axis of the housing 2. The inlet pipe 3 is configured to release the exhaust gas G in a direction that is in parallel to the central axis of the housing 2 (in other words, in front-rear directions of a vehicle, in which the muffler 1 is placed).

<Outlet Pipe>

The outlet pipe 4 is configured to release the exhaust gas G from the inside of the housing 2. The outlet pipe 4 includes a first outlet end 4A, a second outlet end 4B, and a communication hole 4C (see, FIG. 1). The communication hole 4C is at least one in number. The first outlet end 4A opens into the housing 2. The second outlet end 4B opens outward of the housing 2. The communication hole 4C, which is one in number, is formed in an outer circumferential surface of the outlet pipe 4.

The second outlet end 4B is coupled to an exhaust pipe that is located downstream of the muffler 1 in the exhaust gas flow path of the internal combustion engine. The exhaust gas G is released to the outside of the housing 2 through the second outlet end 4B. In the present embodiment, the outlet pipe 4 is a straight pipe that extends in parallel to the central axis of the housing 2. In other words, the outlet pipe 4 is disposed such that the central axis of the outlet pipe 4 and the central axis of the inlet pipe 3 are parallel to each other. Here, respective positions of the outlet pipe 4 and the inlet pipe 3 in up-down directions are not particularly limited. The outlet pipe 4 and the inlet pipe 3 may be disposed to have a positional gap therebetween in the up-down directions.

Further, in the present embodiment, the first outlet end 4A is disposed at a position to overlap with the inlet pipe 3 in a radial direction of the outlet pipe 4 (in other words, right-left directions). The second inlet end 3B of the inlet pipe 3 is disposed at a position to overlap with the outlet pipe 4 in a radial direction of the outlet pipe 4 (in other words, the right-left directions).

Accordingly, the exhaust gas G is released toward the second bottom wall 2B through the second inlet end 3B and thereafter flows toward the first bottom wall 2A in a direction opposite to a flow direction in the inlet pipe 3 by 180 degrees. Then, the exhaust gas G flows into the outlet pipe 4 through the first outlet end 4A, thus flowing again toward the first bottom wall 2A in the outlet pipe 4. A main flow path F of the exhaust gas G from the second inlet end 3B to the first outlet end 4A is configured with such flow of the exhaust gas G.

As shown in FIG. 1B, the communication hole 4C penetrates the outlet pipe 4 in the radial direction of the outlet pipe 4. In the present embodiment, the communication hole 4C is formed in a portion of the outlet pipe 4 that is present in a first muffling space, in which the second inlet end 3B of the inlet pipe 3 is disposed. However, the communication hole 4C may be formed in a portion of the outlet pipe 4 that is present in a muffling space other than the first muffling space. The communication hole 4C is provided to seek reduction of sound pressure of a standing wave in the outlet pipe 4.

In the present embodiment, the communication hole 4C is disposed in an area of the outer circumferential surface of the outlet pipe 4, the area being at a lower side of the outer circumferential surface of the outlet pipe 4 when the muffler 1 is placed in a vehicle, such as an automobile or the like (in other words, the communication hole 4C is visible from downward of the outlet pipe 4). This allows condensate water, which is generated from the exhaust gas in the outlet pipe 4, to be released through the communication hole 4C during, for example, stop of the internal combustion engine. In other words, it is possible to reduce retention of the condensate water in the outlet pipe 4, to thereby inhibit troubles of the internal combustion engine due to entry of the condensate water in the internal combustion engine and/or inhibit blockage of a piping in the downstream of the muffler 1. It should be noted that the area, in which the communication hole 4C is formed, is not limited to the above-described area.

The communication hole 4C is not particularly limited in its shape and can be formed in a circular shape, a polygon shape, or the like. It should be noted that a total area of the communication hole 4C is smaller than an opening area of the first outlet end 4A. An area of the communication hole 4C is adjusted so that a node of the standing wave is not formed at a position where the communication hole 4C of the outlet pipe 4 is formed.

<Cover>

The cover 5 covers a part of the outer circumferential surface of the outlet pipe 4. In the present embodiment, the cover 5 is a cylindrical body that is disposed outside the outlet pipe 4 in a manner to be coaxial with the outlet pipe 4. An inner diameter of the cover 5 is larger than an outer diameter of the outlet pipe 4.

The cover 5 of the present embodiment is tapered at both ends thereof. At these ends, the cover 5 is fixed to the outer circumferential surface of the outlet pipe 4 by, for example, welding. A space S is formed between an inner circumferential surface of the cover 5 and the outer circumferential surface of the outlet pipe 4. The space S communicates with the communication hole 4C of the outlet pipe 4.

As shown in FIG. 1B, the cover 5 includes a wall portion 51, an opening 52, and a guide portion 53. The wall portion 51 is disposed to overlap with the communication hole 4C in the radial direction of the outlet pipe 4. The opening 52 communicates the communication hole 4C and the internal space of the housing 2 with each other. The guide portion 53 is configured to guide the exhaust gas G to the opening 52.

The wall portion 51 is configured with a portion of the cover 5 in which an auxiliary communication hole 52A is not formed. The auxiliary communication hole 52A is described below. The wall portion 51 is disposed such that the communication hole 4C is invisible from the outside of the outlet pipe 4 in the radial direction. In other words, the wall portion 51 is disposed to block flow of the exhaust gas G running from the main flow path F to the communication hole 4C.

The opening 52 of the present embodiment includes the auxiliary communication hole 52A that is provided to the cover 5, the auxiliary communication hole 52A being at least one in number. The auxiliary communication hole 52A penetrates the cover 5 in a direction along a thickness of the cover 5 (thickness direction). The auxiliary communication hole 52A communicates the internal space of the housing 2 and the space S with each other. In other words, the exhaust gas G can flow into the space S only through the auxiliary communication hole 52A.

The opening 52 is disposed at a position that is displaced from the main flow path F of the exhaust gas G running from the second inlet end 3B to the first outlet end 4A (in other words, a position that does no oppose a flow direction of the exhaust gas G running through the main flow path F or a position that does not oppose the second inlet end 3B). In other words, the auxiliary communication hole 52A, which configures the opening 52, is disposed at a position that avoids encounter with a flux of the exhaust gas G that is released through the second inlet end 3B.

In the present embodiment, the auxiliary communication hole 52A is disposed opposite to the communication hole 4C across a virtual plane A that includes the central axis P of the outlet pipe 4. Specifically, the auxiliary communication hole 52A is disposed at a position that is opposite to the communication hole 4C across the central axis P (in other words, a position opposite to the communication hole 4C by 180 degrees with respect to the central axis P). Here, the number of the auxiliary communication hole 52A and the number of the communication hole 4C do not necessarily correspond to each other.

The auxiliary communication hole 52A can be provided at any position that is displaced with respect to the communication hole 4C in at least one of a circumferential direction of the outlet pipe 4 or a central axial direction of the outlet pipe 4. Accordingly, the auxiliary communication hole 52A may be displaced with respect to the communication hole 4C in the central axial direction of the outlet pipe 4.

In the present embodiment, the guide portion 53 is configured with a portion of the cylindrical body to which the auxiliary communication hole 52A is provided. In other words, the guide portion 53 is curved to be continuous with a portion of the outlet pipe 4 in which the auxiliary communication hole 52A is formed in the circumferential direction. For this reason, the guide portion 53 exhibits a function to guide the exhaust gas G to the auxiliary communication hole 52A.

<Separator>

Separators 6 are plate-shaped members that divide the inside of the housing 2 into spaces. The separators 6, which are not shown, include respective openings that allow the exhaust gas G to flow therethrough in a direction along thicknesses of the separators (thickness direction). The spaces in the housing 2 communicate with each other through the openings.

Figure 2:
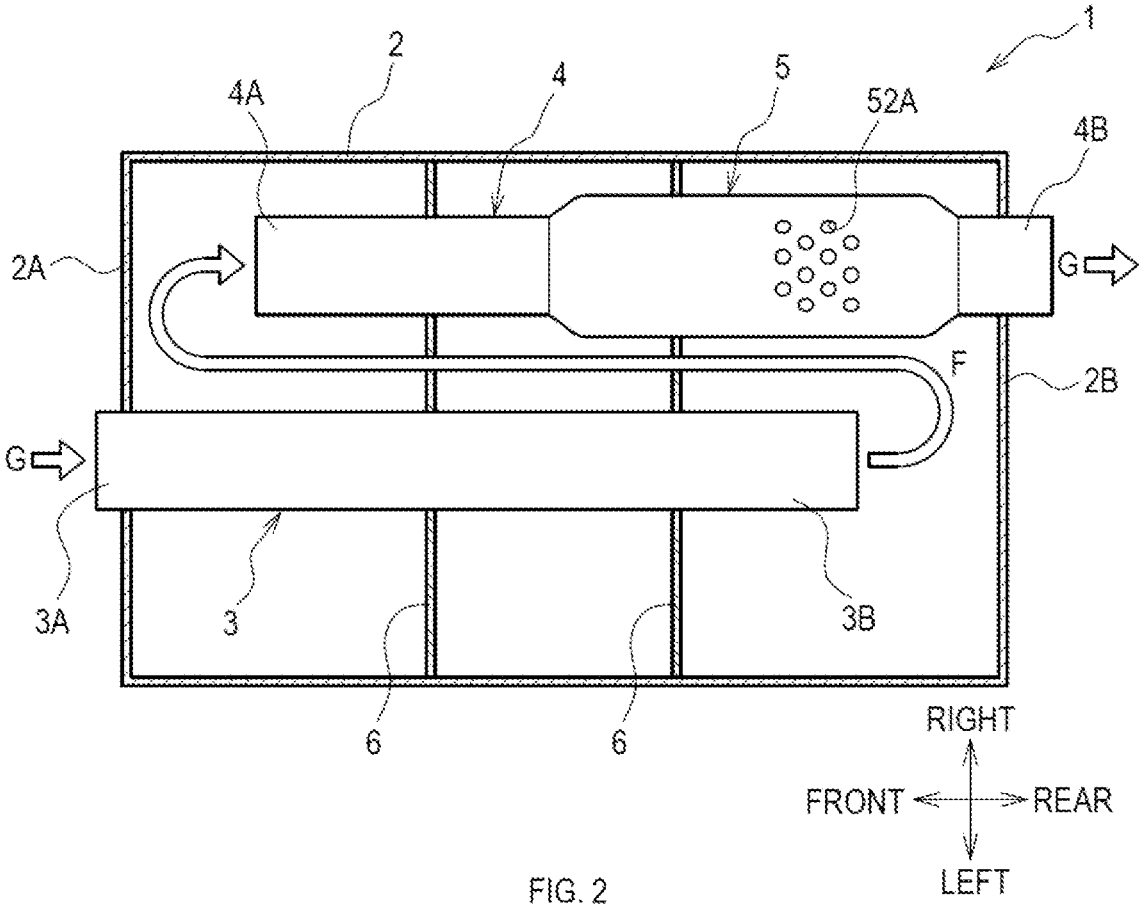
FIG. 2 is a schematic diagram showing an internal configuration of a muffler of an embodiment that is different from the embodiment shown in FIG. 1A.

In the present embodiment, the inlet pipe 3 and the outlet pipe 4 are disposed to penetrate the separators 6. Further, the cover 5 may be disposed to penetrate at least one separator 6, as shown in FIG. 2.

[1-2. Functions]

In the muffler 1, the exhaust gas G, which is released into the housing 2 through the inlet pipe 3, flows toward the first outlet end 4A of the outlet pipe 4 along the main flow path F.

On the other hand, some of the exhaust gas G tend to flow in the outlet pipe 4 from the communication hole 4C of the outlet pipe 4 along a tributary flow path F1 that is branched from the main flow path F and passes through the communication hole 4C of the outlet pipe 4 from the opening 52. This occurs because pressure of the inside of the outlet pipe 4 is low relative to pressure of the outside of the outlet pipe 4 (in other words, the internal space of the housing 2).

In the muffler 1, the wall portion 51 of the cover 5 is disposed to overlap with the communication hole 4C. Therefore, the exhaust gas G, which flows toward the communication hole 4C, detours to the auxiliary communication hole 52A of the cover 5 along the wall portion 51 and the guide portion 53. Then, the exhaust gas G enters, from the auxiliary communication hole 52A, into the space S defined between the outlet pipe 4 and the cover 5. Upon entry into the space S, the exhaust gas G flows along the outer circumferential surface of the outlet pipe 4 and thereafter reaches the communication hole 4C.

The aforementioned tributary flow path F1 allows the exhaust gas G to flow along the tributary flow path F1 into the outlet pipe 4 from the communication hole 4C, which thus greatly decreases a flow speed of the exhaust gas G in the tributary flow relative to a flow speed of the exhaust gas G in the main flow.

[1-3. Effects]

The above detailed embodiment brings the following effects.

(1a) In the outlet pipe 4, a standing wave is formed. The standing wave continues to an exhaust system situated downstream of the first outlet end 4A (for example, a downstream end of a tail pipe). Providing the outlet pipe 4 with the communication hole 4C reduces internal pressure of the outlet pipe 4 in the vicinity of the communication hole 4C. As a result, it is possible to reduce the sound pressure of the standing wave.

(1b) The cover 5, which includes the wall portion 51 and the opening 52, contributes to increase in flow path length of the tributary flow that runs into the outlet pipe 4 from the communication hole 4C. As a result, it is possible to decrease the flow speed of the exhaust gas G in the tributary flow relative to the flow speed of the exhaust gas G in the main flow running into the outlet pipe 4 from the first outlet end 4A. Accordingly, with a help of the communication hole 4C, the sound pressure of the standing wave in the outlet pipe 4 is reduce and, at the same time, generation of flow noise, which occurs when the tributary flow and the main flow are merged together in the outlet pipe 4, is inhibited.

(1c) The total area of the communication hole 4C is smaller than the opening area of the first outlet end 4A, which increases a flow rate of the exhaust gas G flowing into the outlet pipe 4 from the first outlet end 4A relative to a flow rate of the exhaust gas G flowing into the outlet pipe 4 from the communication hole 4C. As a result, the flow speed in the tributary flow decreases, thus properly exhibiting the effect to inhibit generation of the flow noise.

(1d) The opening 52 of the cover 5 is disposed in the position that is displaced from the main flow path F of the exhaust gas G. As a result, the exhaust gas G, which is released from the second inlet end 3B, is less likely to be directly supplied to the opening 52 of the cover 5. Consequently, it is possible to inhibit generation of the flow noise at the opening 52 of the cover 5.

(1e) The opening 52 of the cover 5 includes the auxiliary communication hole 52A, which facilitates adjustment of the flow rate of the exhaust gas G at the opening 52 of this the cover 5. Here, providing multiple communication holes 52A further facilitates adjustment of the flow rate of the exhaust gas G.

(1f) The cover 5 is a cylindrical body that is disposed outside the outlet pipe 4, which facilitates formation of the outlet pipe 4 to which the cover 5 is mounted. As a result, it is possible to enhance productivity of the muffler 1.

(1g) The auxiliary communication hole 52A is disposed opposite to the communication hole 4C, which increases a distance from the auxiliary communication hole 52A to the communication hole 4C. This can further reduce the flow speed of the exhaust gas G in the tributary flow and consequently, expedites the effect to inhibit generation of the flow noise.

(1h) The guide portion 53 guides the exhaust gas G to the auxiliary communication hole 52A. This encourages the exhaust gas G to be collected at the opening 52 of the cover 5, thus inhibiting dispersion of the exhaust gas G (in other words, generation of turbulence) in the housing 2. As a result, the effect to inhibit generation of the flow noise is expedited.

2. Second Embodiment

[2-1. Configuration]

Figure 3A:
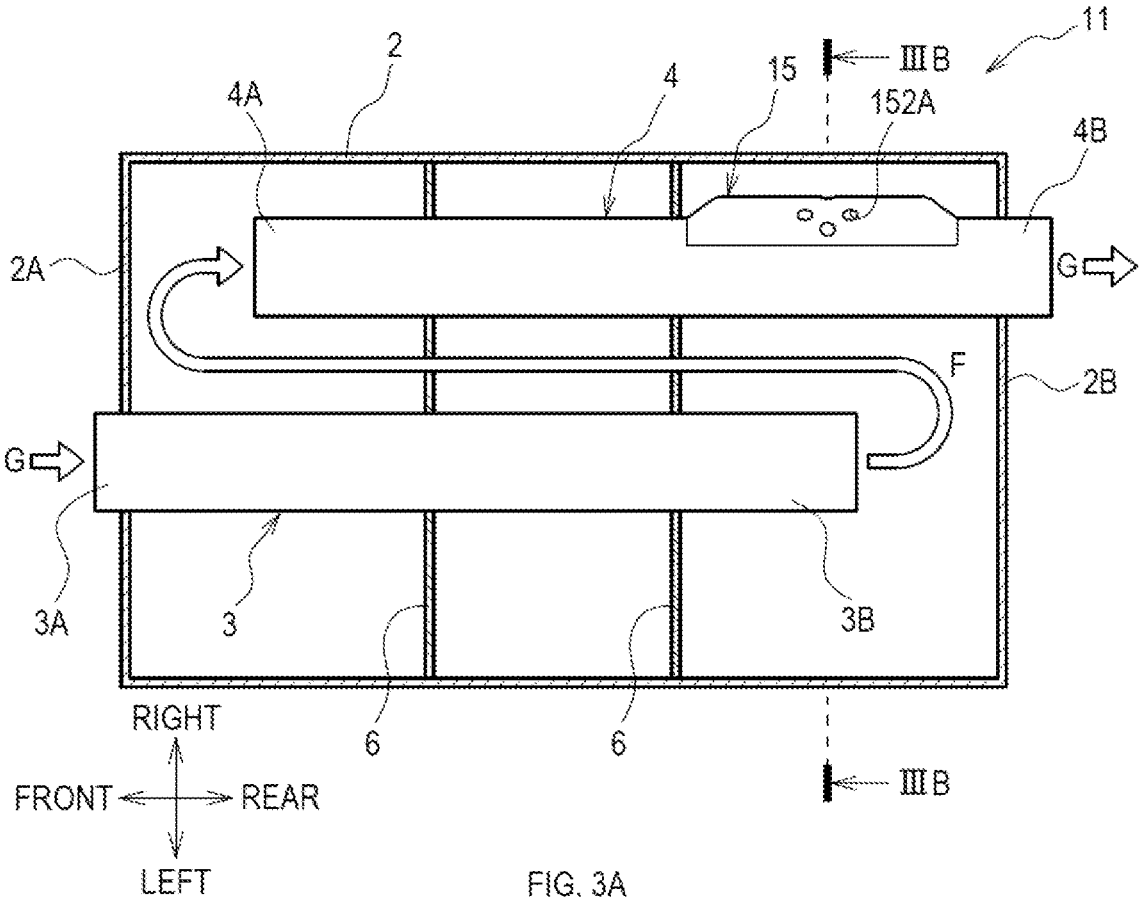
FIG. 3A is a schematic diagram showing an internal configuration of a muffler of an embodiment that is different from the embodiment shown in FIG. 1A.

A muffler 11 shown in FIG. 3A comprises the housing 2, the inlet pipe 3, the outlet pipe 4, a cover 15, and the separators 6. The housing 2, the inlet pipe 3, the outlet pipe 4, and the separators 6 are identical to those of the muffler 1 of FIG. 1A and therefore, descriptions of these components will be omitted.

Figure 3B:
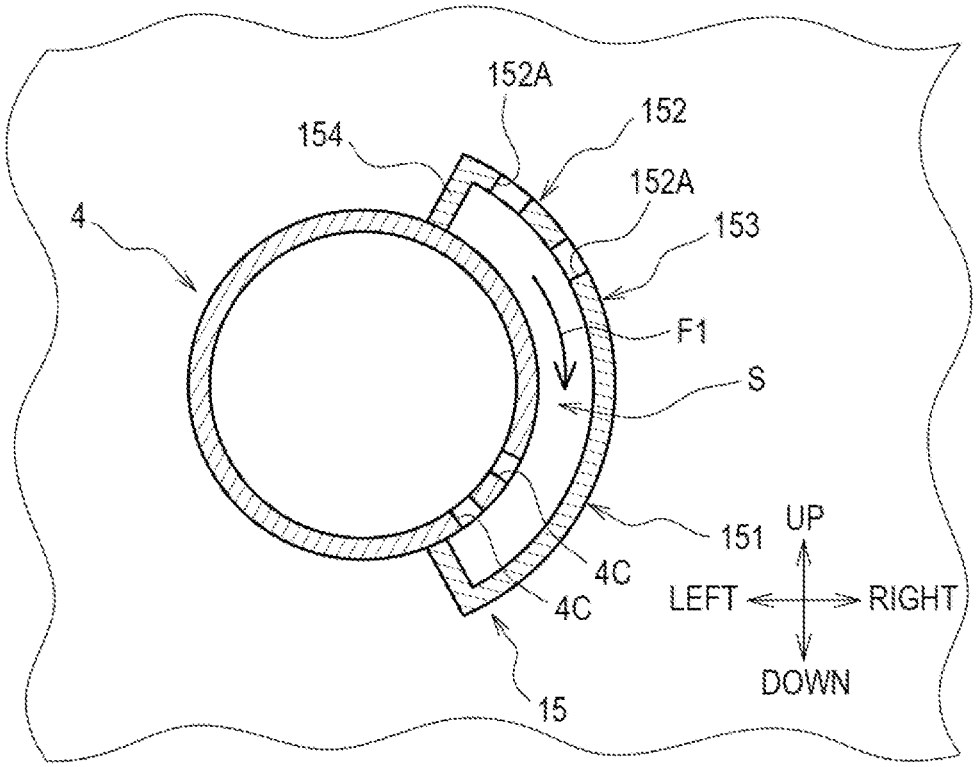
FIG. 3B is a schematic partial sectional view along a line IIIB-IIIB of FIG. 3A.

As with the cover 5 of FIG. 1A, the cover 15 of the present embodiment includes, as shown in FIG. 3B, a wall portion 151, an opening 152, and a guide portion 153. The wall portion 151 is disposed to overlap with at least one communication hole 4C in the radial direction of the outlet pipe 4. The opening 152 communicates the communication hole 4C and the internal space of the housing 2 with each other. The guide portion 153 is configured to guide the exhaust gas G to the opening 152. Further, the opening 152 includes an auxiliary communication hole 152A that is provided to the cover 15. The auxiliary communication hole 152A is at least one in number.

The cover 15 covers a part of the outer circumferential surface of the outlet pipe 4 in the circumferential direction of the outlet pipe 4. Specifically, the cover 15 includes a partial cylinder and a leg portion 154. The partial cylinder includes the wall portion 151, the opening 152, and the guide portion 153 that are disposed to oppose the outer circumferential surface of the outlet pipe 4. The leg portion 154 fixes the partial cylinder to the outlet pipe 4. The leg portion 154 is fixed to the outer circumferential surface of the outlet pipe 4 by, for example, welding.

The wall portion 151, the opening 152, and the guide portion 153 are held in respective positions by the leg portion 154, the respective positions being distanced from the outer circumferential surface of the outlet pipe 4. The leg portion 154 defines, together with the wall portion 151, the opening 152, and the guide portion 153, the space S between the outlet pipe 4 and the cover 15. A cross section of the space S, which is perpendicular to the central axis of the outlet pipe 4, is formed in a fan-shape.

[2-2. Effects]

The above detailed embodiment brings the following effects.

(2a) The cover 15 is shaped to cover only a portion of the outlet pipe 4 in the circumferential direction, which can reduce the cover 15 in size as minimum as required. As a result, it is possible to reduce a material cost of the muffler 11.

3. Third Embodiment

[3-1. Configuration]

Figure 4A:
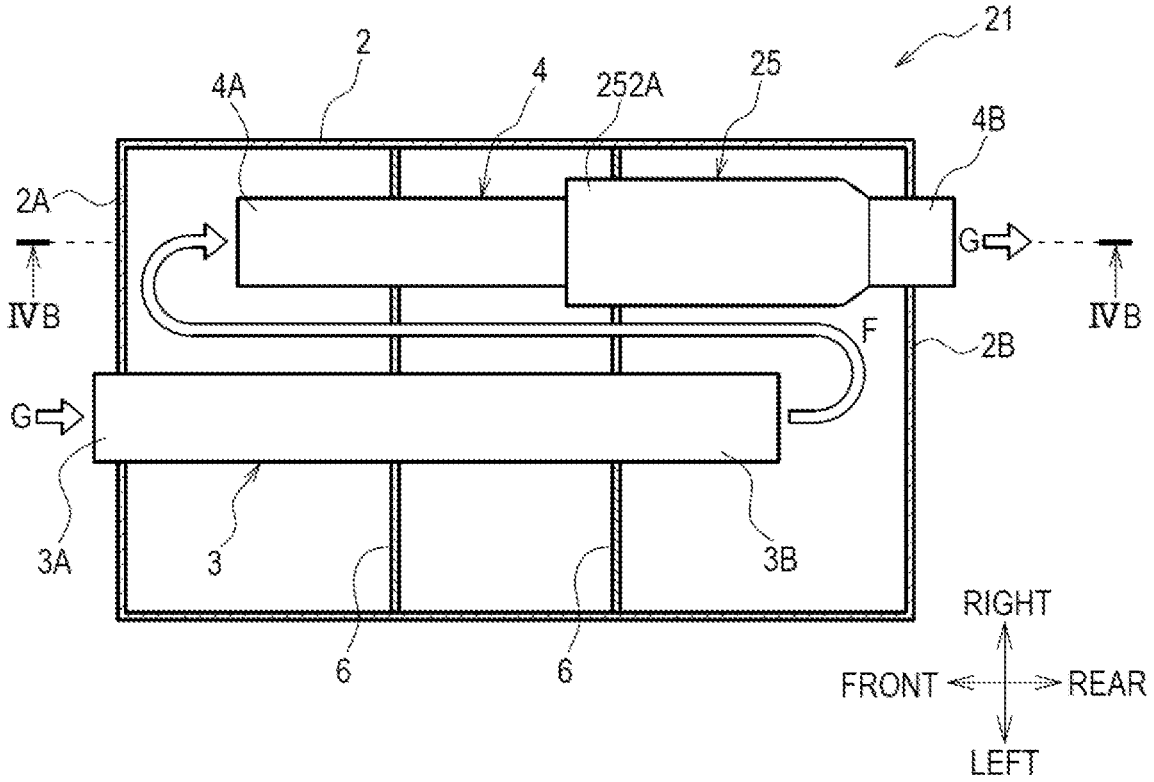
FIG. 4A is a schematic diagram showing an internal configuration of a muffler of an embodiment that is different from the respective embodiments shown in FIGS. 1A and 3A.
Figure 4B:
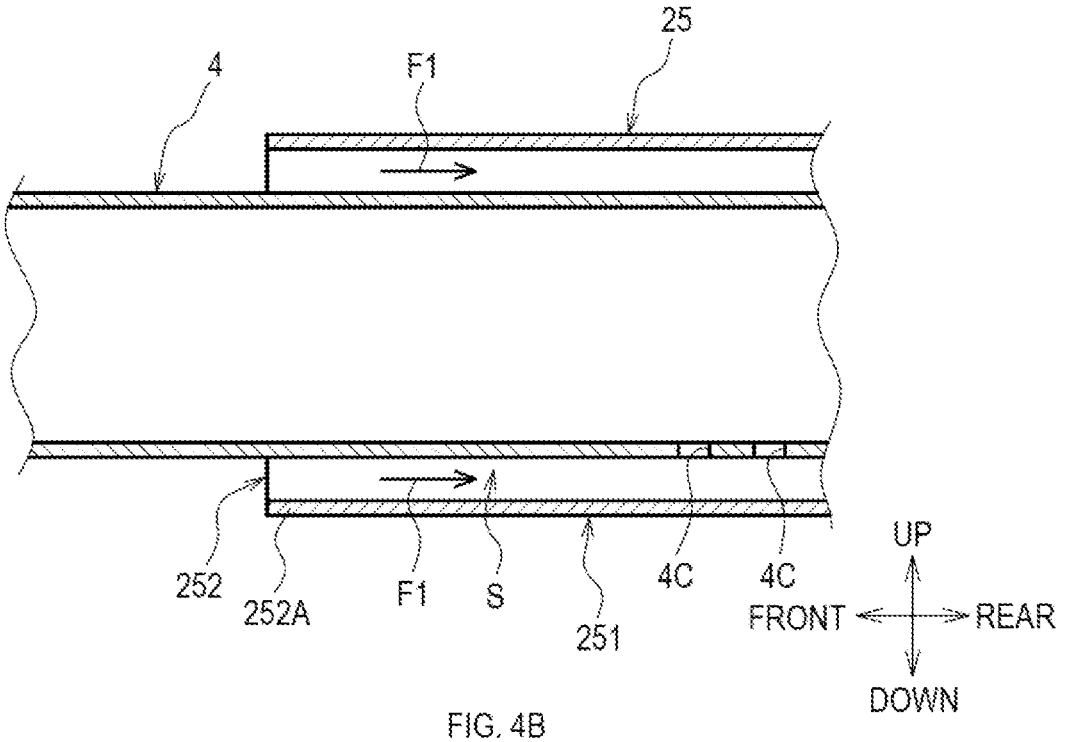
FIG. 4B is a schematic partial sectional view along a line IVB-IVB of FIG. 4A.

A muffler 21 shown in FIG. 4A comprises the housing 2, the inlet pipe 3, the outlet pipe 4, a cover 25, and the separators 6. The housing 2, the inlet pipe 3, outlet pipe 4, and the separators 6 are identical to those of the muffler 1 of FIG. 1A and therefore, descriptions of these components will be omitted.

As with the cover 5 of FIG. 1A, the cover 25 of the present embodiment includes a wall portion 251 and an opening 252. The wall portion 251 is disposed to overlap with the communication hole 4C in the radial direction of the outlet pipe 4. The opening 252 communicates the communication hole 4C and the internal space of the housing 2 with each other. Further, the cover 25 is a cylindrical body that is disposed outside the outlet pipe 4 and coaxially with the outlet pipe 4.

The opening 252 of the cover 25 is provided to have a specified distance from the outer circumferential surface of the outlet pipe 4. Further, the opening 252 includes an opened end 252A that is configured to introduce the exhaust gas G between the wall portion 251 and the outer circumferential surface of the outlet pipe 4.

Specifically, the cover 25 has a first end and a second end. As shown in FIG. 4A, the first end of the cover 25 is situated closer to the second bottom wall 2B of the housing 2 than the second end is. The first end of the cover 25 is fixed to the outer circumferential surface of the outlet pipe 4 and is therefore sealed. On the other hand, the second end of the cover 25, which is situated closer to the first bottom wall 2A than the first end is, is the opened end 252A.

In the muffler 21, the exhaust gas G enters, from the opened end 252A, into the space S provided between an inner circumferential surface of the cover 25 and the outer circumferential surface of the outlet pipe 4 and then forms a tributary flow that runs into the outlet pipe 4 from the communication hole 4C.

[3-2. Effects]

The above detailed embodiment brings the following effects.

(3a) The third embodiment eliminates need of fixing work for fixing the cover 25 to the outlet pipe 4 at one end of the cover 25. Therefore, it is possible to reduce a man-hour of the fixing work for fixing the cover 25 to the outlet pipe 4 using, for example, welding. As a result, the muffler 21 has enhanced productivity.

4. Other Embodiments

Accordingly, the embodiments of the present disclosure have been described. However, the present disclosure is not limited to the above-described embodiments and can be practiced in various forms.

Figure 5A:
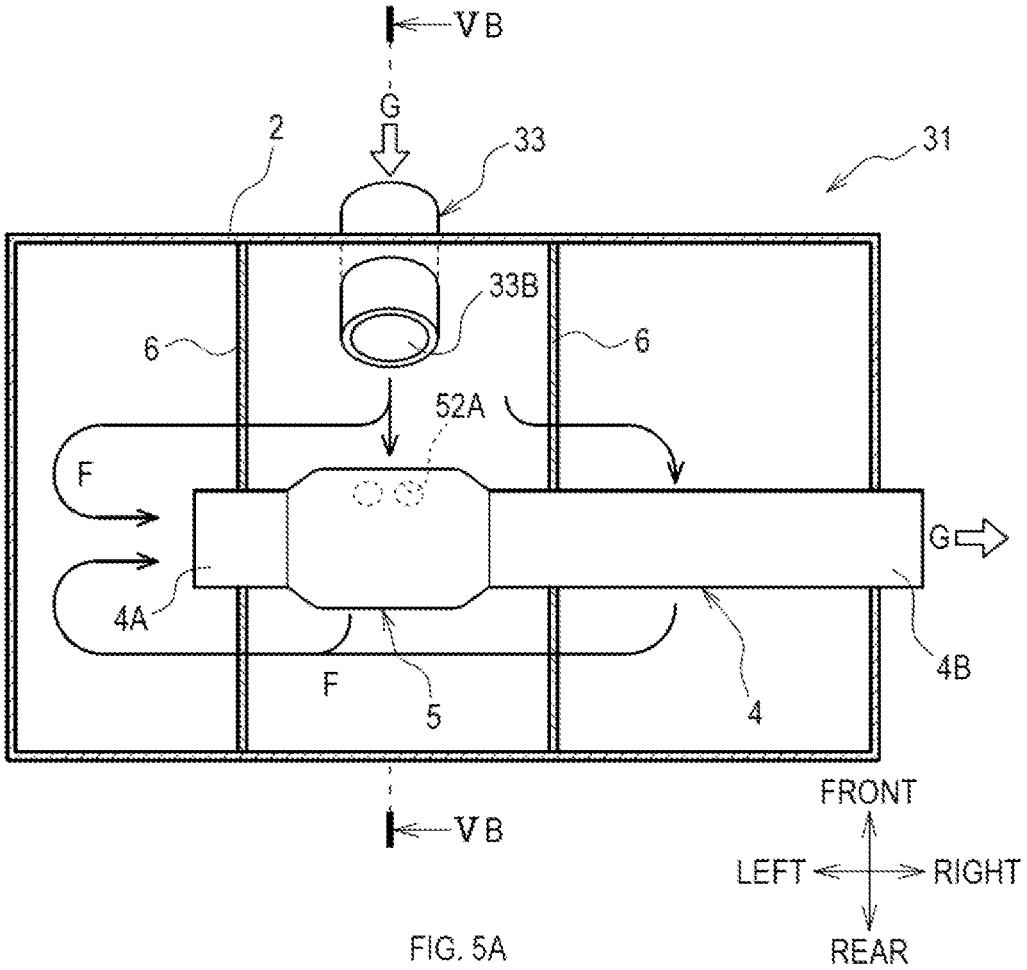
FIG. 5A is a schematic diagram showing an internal configuration of a muffler of an embodiment that is different from the respective embodiments shown in FIGS. 1A, 3A, and 4A.

(4a) In the muffler of the aforementioned embodiments, the inlet pipe does not necessarily release the exhaust gas in the direction parallel to the central axis of the outlet pipe. As in the case of a muffler 31 shown in FIGS. 5A and 5B, for example, an inlet pipe 33 may release the exhaust gas G in a direction perpendicular to the central axis of the outlet pipe 4 (specifically, in the circumferential direction of the outlet pipe 4).

In the muffler 31, the inlet pipe 33 has a first inlet end (drawing omitted) and a second inlet end 33B. The first inlet end opens outward of the housing 2. The second inlet end 33B opens into the housing 2. The inlet pipe 33 penetrates the housing 2 in a circumferential direction of the housing 2.

Figure 5B:
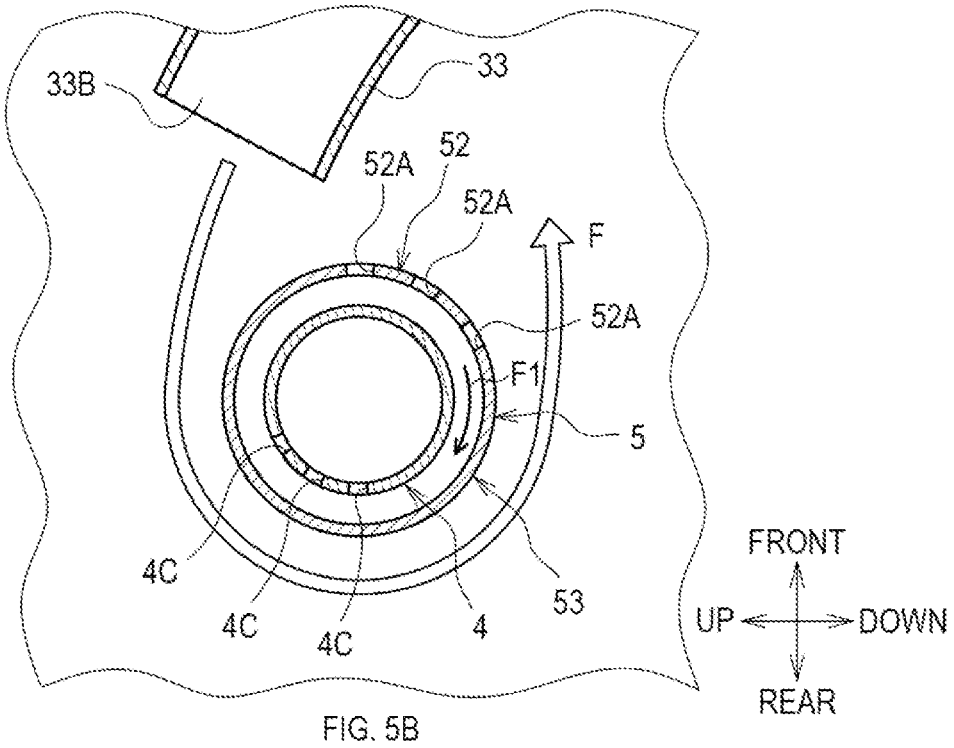
FIG. 5B is a schematic partial sectional view along a line VB-VB of FIG. 5A.

The cover 5 of the muffler 31 is the same as the cover 5 of the muffler of FIG. 1. In the muffler 31, the main flow path F of the exhaust gas G from the second inlet end 33B to the first outlet end 4A runs around the outside of the cover 5, as shown in FIG. 5B. Some of the exhaust gas G enter into the cover 5 from the auxiliary communication hole 52A and further forms a tributary flow running into the outlet pipe 4 from the communication hole 4C.

(4b) In the muffler of the aforementioned embodiments, the opening of the cover is preferably disposed at a position that is displaced from the main flow path of the exhaust gas running from the second inlet end to the first outlet end. However, the opening of the cover may not be necessarily disposed in the position that is displaced from the main flow path of the exhaust gas. For example, the opening of the cover may be disposed at a position that opposes the second inlet end.

(4c) In the muffler 1 of the aforementioned embodiment, the auxiliary communication hole 52A may not be necessarily disposed opposite to the communication hole 4C. For example, in the muffler 1, when the auxiliary communication hole 52A are plural in number, the auxiliary communication holes 52A may be disposed to interpose the communication hole 4C therebetween along the circumferential direction of the outlet pipe 4.

(4d) In the muffler of the aforementioned embodiments, the opening of the cover may include an opened end shown in FIG. 4A in addition to the auxiliary communication hole shown in FIG. 1A or 2A. In other words, the cover may include an opening that is a combination of the auxiliary communication hole and the opened end.

(4e) Functions of one component in the aforementioned embodiments may be distributed to two or more components. Functions of two or more components may be integrated by one component. A part of the structures of the aforementioned embodiments may be omitted. At least a part of structures of the aforementioned embodiments may be added to or replaced with other structures of another one of the aforementioned embodiments. It should be noted that any and all modes that are encompassed in the technical ideas identified by the languages in the claims are embodiments of the present disclosure.

What is claimed is:

1. A muffler comprising:

a housing;

an inlet pipe configured to introduce exhaust gas into the housing;

an outlet pipe including a first outlet pipe end arranged within and opening into the housing and a second outlet pipe end arranged outside the housing, the outlet pipe being configured to receive exhaust gas from an inside of the housing via the first outlet pipe end and release the exhaust gas through the second outlet pipe end; and a cover covering at least a part of an outer circumferential surface of the outlet pipe, wherein the outlet pipe includes at least one communication hole formed in the outer circumferential surface of the outlet pipe at a position between the first outlet pipe end and the second outlet pipe end, and wherein the cover includes a wall portion and an opening, the wall portion being disposed to overlap with the at least one communication hole in a radial direction of the outlet pipe and the opening communicating the at least one communication hole and an internal space of the housing with each other, wherein the opening of the cover includes at least one auxiliary communication hole that penetrates the cover, and wherein the cover is a cylindrical body that is disposed outside the outlet pipe.

2. The muffler according to claim 1, wherein a total area of the at least one communication hole is smaller than an opening area of the first outlet pipe end.

3. The muffler according to claim 1, wherein the inlet pipe includes a second inlet pipe end arranged within and opening into the housing, and wherein the opening of the cover is disposed at a position that is displaced from a main flow path of the exhaust gas running from the second inlet pipe end to the first outlet pipe end.

4. The muffler according to claim 3, wherein the inlet pipe further includes a first inlet pipe end arranged outside the housing.

5. The muffler according to claim 1, wherein the at least one auxiliary communication hole is disposed at a position that is displaced with respect to the at least one communication hole in at least one of a circumferential direction of the outlet pipe or a central axial direction of the outlet pipe.

6. The muffler according to claim 1, wherein the at least one auxiliary communication hole is disposed opposite to the at least one communication hole across a virtual plane that includes a central axis of the outlet pipe.

7. The muffler according to claim 1, wherein the cover covers a part of an outer circumferential surface of the outlet pipe in a circumferential direction of the outlet pipe.

8. The muffler according to claim 1, wherein the cover includes a guide portion that is configured to guide the exhaust gas to the opening of the cover.

9. The muffler according to claim 1, wherein the opening of the cover is disposed to have a specified distance from the outer circumferential surface of the outlet pipe, and the opening of the cover includes an opened end that is configured to introduce the exhaust gas between the wall portion and the outer circumferential surface of the outlet pipe.

* * * * *